United States Patent [19]

Winkle, Sr. et al.

[11] Patent Number: 5,059,446

[45] Date of Patent: Oct. 22, 1991

[54] METHOD OF PRODUCING PLASTIC COATED METAL STRIP

[75] Inventors: Sherman E. Winkle, Sr., Franklin; Lloyd E. Cockerham; Frederick A. Myers, both of Middletown, all of Ohio

[73] Assignee: Armco Inc., Middletown, Ohio

[21] Appl. No.: 480,381

[22] Filed: Feb. 14, 1990

[51] Int. Cl.[5] ..... B05D 1/04

[52] U.S. Cl. ..... 427/32; 264/241; 427/55; 427/195; 427/196; 427/289; 427/290; 427/292; 427/293; 427/309; 427/318; 427/327; 427/374.2; 427/374.4; 427/375; 427/385.5; 427/386; 427/424; 427/434.2; 427/435

[58] Field of Search ..... 427/32, 55, 289, 290, 427/309, 318, 327, 374.2, 374.4, 375, 424, 195, 196, 292, 293, 385.5, 386, 434.2, 435; 264/241

[56] References Cited

U.S. PATENT DOCUMENTS

| | | | |
|---|---|---|---|
| 3,396,699 | 8/1968 | Beebe et al. | 118/634 |
| 3,439,649 | 4/1969 | Probst et al. | 118/634 |
| 3,560,239 | 2/1971 | Facer et al. | 117/17 |
| 4,244,985 | 1/1981 | Graff et al. | 427/27 |
| 4,325,982 | 4/1982 | Gillette et al. | 427/32 |

FOREIGN PATENT DOCUMENTS

| | | |
|---|---|---|
| 146366 | 7/1986 | Japan . |
| 1273159 | 5/1972 | United Kingdom . |

OTHER PUBLICATIONS

Center for Metals Fabrication, "Short Wave Infrared Curing", 1987, vol. 1, No. 1.

*Primary Examiner*—Bernard Pianalto

*Attorney, Agent, or Firm*—R. J. Bunyard; L. A. Fillnow; R. H. Johnson

[57] ABSTRACT

Process and apparatus for forming a plastic coating on a metal strip. A metal strip is cleaned, surface treated, coated with an electrostatically charged plastic powder in an enclosed chamber using a plurality of spray guns positioned on both sides of the strip, inductively heated to above the melting point of the powder, and maintained in an infrared heater until the fused powder is flowed into a coating having a smooth surface and a uniform thickness. Thermoplastic and thermosetting coatings, having thicknesses of at least 10 microns formed using total induction and infrared heating times of less than 60 seconds, can be fabricated without cracking.

18 Claims, 2 Drawing Sheets

METHOD OF PRODUCING PLASTIC COATED METAL STRIP

BACKGROUND OF THE INVENTION

This invention relates to forming a protective coating on a continuously moving metal strip. More particularly, this invention relates to forming a smooth plastic coating from electrostatically charged powder.

It is well known to continuously coat metal strip with solvent based paint. Painted metals can be fabricated by deep drawing, shaping, or roll forming into a variety of articles including building panels, lock seam culvert, appliance components, vehicular components and the like. The strip surfaces are cleaned and degreased and liquid paint is applied using a roll coater, gravure, dipping, spraying, electrocoating, and the like. The conventional manner of drying liquid paint is driving off the solvent using a long convention oven.

There are several disadvantages when using a solvent based paint. Convection heating is very inefficient because of poor heat transfer through the air between the oven heaters and the metal strip. This necessitates a very long oven and/or a very slow strip speed to dry the coating. Solvent fumes are an environmental concern requiring the oven to be enclosed to prevent release of the fumes into the work area. Certain types of fumes may have to be recycled to an incinerator for disposal. There also is environmental concern associated with maintaining the work area in and around the coating station. The wastes from cleaning the coating equipment and the work area may be hazardous and therefore must be disposed of properly. There also are several disadvantages with the coating itself. Only thin coatings generally can be produced and poor surface coverage is a problem when paint is applied to an embossed or coined metal surface. Since drying of the paint when using convection heating occurs from the outside toward the inside, blistering of the paint also may occur.

It is known to form pollution free thin plastic coatings on a metal surface using electrostatically charged powder that may be melted in a short period of time, i.e. less than one minute, using infrared heating. For example, U.S. Pat. No. 3,396,699 discloses continuously passing metal wire or strip through an enclosed chamber containing a suspended cloud of electrostatically charged plastic powder. An epoxy coating having a thickness of 38 microns is formed by passing powder coated wire through an infrared heated oven. U.S. Pat. No. 3,560,239 discloses plastic powder coating steel wire or strip by preheating using an induction coil, passing the steel through a fluidized powder coating chamber, melting the powder by passing the steel through another induction coil, and then water quenching the liquid coating. U.S. Pat. No. 4,244,985 discloses using a fluidized bed to coat metal tubing or wire with a thermosetting powder. The patent discloses thermosetting coatings having thicknesses in the range of 25–75 microns. Examples of induction coil heating times of 3–14 seconds are given.

It also is known to coat a metal surface with electrostatically charged powder using spray guns. U.S. Pat. No. 3,439,649 discloses electrostatic spray guns positioned inside an enclosed coating chamber for coating a preheated steel strip with plastic powder. A coating thickness of about 3–13 microns is disclosed when a perpendicularly directed spray gun is positioned about 15 cm above and below the strip surfaces. British patent 1,273,159 discloses positioning an inclined nozzle both above and below a moving metal strip for blowing a gas jet carrying plastic powder toward the strip. The powder is electrostatically charged using a wire grid positioned inside the coating chamber.

Nevertheless, there remains a need for a coating process for applying powder that can be melted to form a coating having a uniform thickness and whose surface is smooth and free of cosmetic imperfections. More particularly, there remains a need for forming a ductile thermosetting coating that is sufficiently cured to resist cracking and provide corrosion resistance when the coated metal strip is fabricated into an article. Furthermore, there remains a need to cure a thermosetting coating in a short period of time to minimize coating line length, the amount of space required, and to permit increased coating line speed.

BRIEF SUMMARY OF THE INVENTION

The invention relates to forming a coating on a continuously moving metal strip from electrostatically charged powder. A metal strip is cleaned of dirt, oil, oxides, and the like, surface treated, passed through an enclosed coating chamber to coat both sides of the strip with electrostatically charged powder, inductively heated to a temperature above the melting point of the powder, and maintained above the melting point of the fused coating for sufficient time to form a coating having a smooth surface and a uniform thickness on each surface of the strip. The powder is carried by a pressurized gas and blown from a spray gun having an electrostatic charging nozzle. A plurality of the guns is positioned on both sides of the strip with the nozzles generally being aligned parallel to the rolling direction of the moving strip.

A principal object of the invention is to form a coating having uniform thickness on both sides of a metal strip using electrostatically charged powder. Additional objects of the invention include forming a plastic coating using a short total heating time, differentially coating a metal strip, and being able to provide a smooth plastic coating on an embossed strip.

A feature of the invention includes surface treating a continuously moving metal strip, passing the treated strip through an enclosed coating chamber, coating both sides of the strip with a powder, the powder being carried by a pressurized gas and blown from an electrostatic spray gun, inductively heating the strip to a temperature above the melting point of the powder, and maintaining the coated strip in a second heater above the melting point of the powder so that the fused coating has sufficient time to form an adherent coating having a smooth surface and a uniform thickness.

Another feature of the invention includes continuously cleaning a metal strip of dirt, oil, oxides, and the like, surface treating the cleaned strip, horizontally passing the treated strip through an enclosed coating chamber, coating both sides of the strip with a plastic powder, the powder being carried by a pressurized gas and blown from an electrostatic spray gun, inductively heating the strip to a temperature above the melting point of the powder, and maintaining the coated strip in a second heater above the melting point of the powder so that the fused coating has sufficient time to form an adherent coating having a smooth surface and a uniform thickness.

Another feature of the invention includes forming a strip into a continuous string of blanks ready for forming, cleaning the blanks of dirt, oil, oxides, and the like, surface treating the cleaned blanks, passing the treated blanks through an enclosed coating chamber, coating both sides of the blanks with a plastic powder, the powder being carried by a pressurized gas and blown from an electrostatic spray gun, inductively heating the blanks to a temperature above the melting point of the powder for sufficient time to form an adherent coating having a smooth surface and a uniform thickness.

Another feature of the invention includes continuously cleaning a metal strip of dirt, oil, oxides, and the like, surface treating the cleaned strip, horizontally passing the treated strip through an enclosed coating chamber, coating both sides of the strip with a thermosetting plastic powder, the powder being carried by a pressurized gas and blown from an electrostatic spray gun, inductively heating the strip to a temperature above the melting point of the powder using a frequency no greater than 10 kHz, and maintaining the coated strip in a second heater above the melting point of the powder so that the fused coating has sufficient time to form a cured coating having a smooth surface and a uniform thickness.

Another feature of the invention includes continuously cleaning a metal strip of dirt, oil, oxides, and the like, surface treating the cleaned strip, horizontally passing the treated strip through an enclosed coating chamber, coating both sides of the strip with electrostatically charged thermosetting plastic powder, inductively heating the strip to a temperature above the melting point of the powder using a frequency no greater than 10 kHz, maintaining the strip in a second heater above the melting point of the powder so that the fused coating has sufficient time to form a cured coating having a smooth surface and a uniform thickness, forming the coated strip into an article while the coated strip is at a temperature of at least the glass transition temperature of the coating, whereby the coating on the formed article is free of cracks.

Another feature of the invention includes positioning a plurality of electrostatic spray guns on each side of the strip and generally aligning the spray guns parallel to the rolling direction of the strip with one of the spray guns positioned on one side of the strip being transversely offset relative to another of the spray guns positioned on the same side of the strip.

Another feature of the invention includes positioning a plurality of electrostatic spray guns on each side of the strip and generally aligning the spray guns parallel to the rolling direction of the strip, one of the spray guns on one side of the strip blowing powder in the same direction as the movement of the strip, and another of the spray guns on the same side of the strip blowing powder in the opposite direction.

Another feature of the invention includes positioning a plurality of electrostatic spray guns on each side of a horizontally moving strip and generally aligning the spray guns parallel to the rolling direction of the strip, one of the spray guns positioned on each side of the strip facing toward the entrance end of the coating chamber and another of the spray guns on each side of the strip facing toward the exit end of the coating chamber.

Another feature of the invention includes positioning a plurality of electrostatic spray guns on each side of a horizontally moving strip and generally aligning the spray guns parallel to the rolling direction of the strip, all of the spray guns above the strip being positioned outside the coating chamber.

Another feature of the invention includes inductively heating the powder for a time of less than 10 seconds.

Another feature of the invention includes curing an induction fused thermosetting coating using an infrared heater wherein the total heating time is less than 60 seconds.

Advantages of the invention include environmental safety, elimination of coating defects, thicker coatings having uniform thickness and cure, minimization of coating line down time when color change is required, good formability of plastic coated metal strip without cracking or flaking of the coating, eliminating cut edge corrosion on coated metal blanks, and reduced costs.

The above and other objects, features and advantages of the invention will become apparent upon consideration of the detailed description and appended drawings.

DETAILED DESCRIPTION OF THE PREFERRED EMBODIMENT

Figure 1:
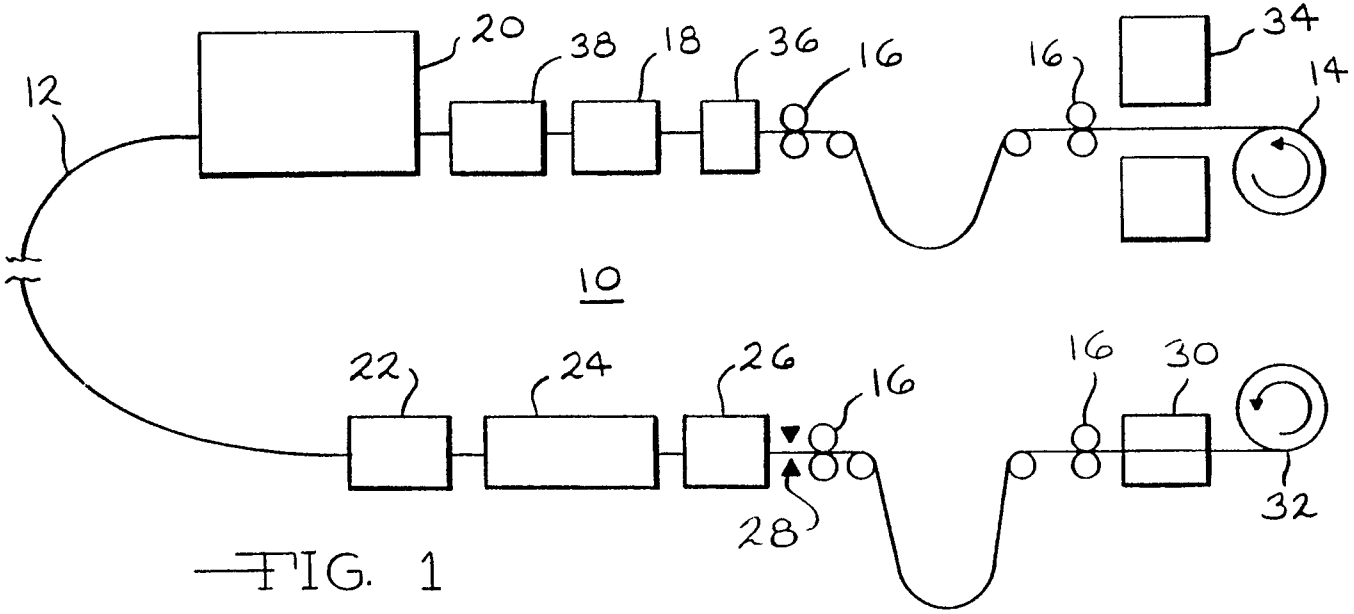
FIG. 1 is a schematic view illustrating a coating line incorporating the invention for applying a plastic coating to a metal strip.

Referring to FIG. 1, reference numeral 10 generally refers to a coating line incorporating the invention. A metal strip 12 such as annealed cold reduced steel is unwound from a coil on an uncoiler 14 by drive rollers 16. Strip 12 must be surface treated as indicated by numeral 18, electrically grounded by a metal contact roller, and horizontally passed through an enclosed chamber 20 where plastic powder is negatively or positively charged using a voltage of about 20–90 KV and thereafter deposited onto the top and bottom surfaces of strip 12. It will be understood strip 12 also could be vertically passed through chamber 20. After being coated with a plastic powder, strip 12 is passed through an induction coil 22 wherein the powder is heated to a temperature at least equal to its melting point. Thereafter, the coated strip is passed through another heater 24, such as an infrared heater having a wave length of 0.8–3.3 microns. For thermoplastic powder, the molten coating must be maintained at or above its melting point in heater 24 for sufficient time to allow the coating to flow into a smooth surface. For thermosetting powder, the molten coating must be maintained at or above its curing temperature in heater 24 for sufficient time to not only flow into a smooth surface but also allow the coating to become substantially cured. After the flowing and/or curing is completed, the fused coating is cooled rapidly to form a tightly adherent coating by passing coated strip 12 through a liquid quench 26, such as water. Quenched strip 12 is then dried by a dryer 28, such as a pair of air knives for blowing the water from strip 12. Dried strip 12 then may be cut into lengths by a shear 30 or rewound into a coil by a coiler 32.

The strip surfaces must be treated to develop a tight adherence between the metal substrate and the plastic coating and may include either a chemical treatment or a mechanical treatment. Chemical treatments are well known and may include activating the metal substrate surface by any one of phosphating, chromating, or using complex oxides. A mechanical treatment, e.g., grit blasting, also could be used.

Coating line 10 optionally may include a pair of opposing presses 34, a cleaner 36, or a preheater 38. It is advantageous to prepunch strip 12 into a continuous series or string of blanks ready for forming by a customer. The continuous string of blanks is processed on coating line 10 and cut into lengths by shear 30. The costs of powder and heating those portions of the strip that otherwise would have been scraped during the forming operation now can be saved since the steel that would have been scraped now can be removed from strip 12 by presses 34 prior to cleaning, surface treating, and powder coating. Steel scrap removed from strip 12 while being processed on coating line 10 also would be more valuable, environmentally acceptable, and easily recycled since the scrap would not include surface contaminates such as cleaners, chemical treatments, and plastic coatings as it otherwise would if removed by the customer. Prepunching or piercing the strip prior to coating with plastic also eliminates cut edge corrosion. The cut edges of the blanks formed when punching the strip are readily covered by the charged powder and protected from corrosion by the plastic coating. When the blanks are punched after coating, the cut metal edges remain exposed and may corrode. Any number of known cleaning treatments such as brushing, electrolytic cleaning, chemical cleaning or ultrasonic cleaning may be used immediately prior to surface treatment 18. After surface treatment 18, strip 12 may be preheated by passing through an induction heater 38. Preheater 38 is used to heat strip 12 to an elevated temperature when it is desired to apply thick coatings of about 125 microns or more to a metal strip.

It will be understood plastic powders of the invention is meant to include thermoplastic and thermosetting generally having a particle size of about 20–100 microns in diameter. Acceptable thermosetting powders include polyester, epoxy, polyester-epoxy hybrid, acrylic and urethane. It also will be understood coatings formed when using these powders in accordance with the invention generally include thicknesses of at least about 10 microns. Drawn appliance components require coatings having good forming characteristics, excellent surface quality and corrosion resistance, and thicknesses of about 25–125 microns. Applications such as lockseam formed culvert or transmission pipe requiring thicker coatings of about 125–250 microns generally need good forming characteristics but not necessarily good cosmetic appearance.

It will be understood by strip is meant to include sheet thicknesses of 0.25 mm or more and foil thicknesses of less than 0.25 mm. For sheet thicknesses of about 0.25 mm or more, a low induction frequency of less than 10 kHz, preferably is used. For foil thicknesses of less than 0.25 mm such as electrical steel or amorphous metals, high frequencies up to 450 kHz may be used. Unlike noninduction heating which generally heats the outer surface of the coating, induction heating heats from the inside out. That is to say, the inner portion of the coating cross section is heated first with the surface portions of the coating being heated last. For steel strip having a thickness of about 0.75 mm or more, a frequency of about 3–6 kHz preferably is used to uniformly heat the entire cross section of the coating. For thermosplastic powder, heater 24 allows the fused coating material to remain molten for sufficient time, e.g., at least 5 seconds, to flow the coating material to even out any thickness nonuniformity and have a smooth surface. If thermosetting powder is used, heater 24 has the additional function of holding the fused coating for sufficient time, e.g. at least 15 seconds, above the curing temperature to substantially complete the curing to form a ductile coating so that the coated strip can be fabricated without cracking the coating.

Figure 2:
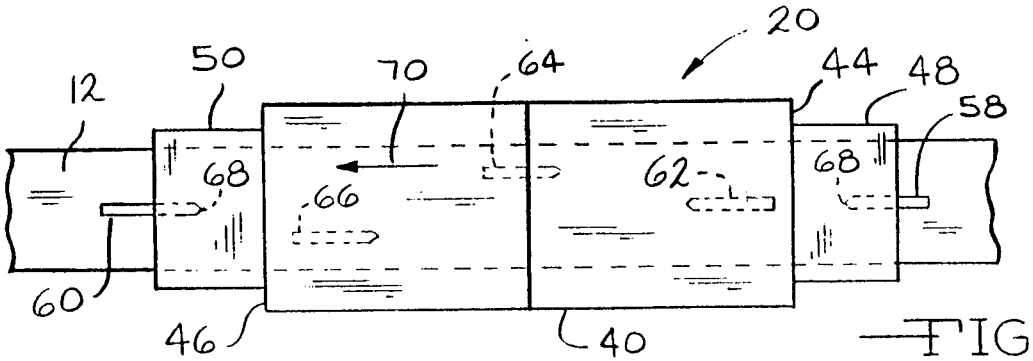
FIG. 2 is a plan view of the coating chamber of FIG. 1 illustrating one embodiment of an opposed and staggered positioning of the spray guns.
Figure 4:
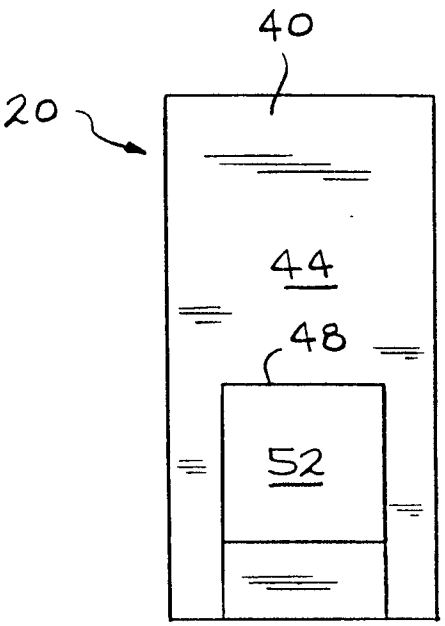
FIG. 4 is an end elevation view of the strip entrance of the coating chamber of FIG. 2 with the strip and spray gun removed from the vestibule opening for clarity.

FIG. 2 illustrates disposition of upper spray guns 58, 60 and lower spray guns 62, 64, 66 when strip 12 having a width of 30.5 cm was horizontally processed on a laboratory coating line. Coating chamber 20 is generally enclosed by a wall 40 and includes a chamber bottom 42 (FIG. 3), a strip entrance wall 44, a strip exit wall 46, and a pair of chamber access doors 54, 56. Entrance wall 44 includes a vestibule 48 for receiving strip 12 and strip exit wall 46 includes a vestibule 50 for exiting strip 12. Coating chamber 20 also includes a gas recirculating system (not shown) for collecting powder which does not become attached to strip 12. Coating chamber 20 is maintained at a reduced pressure so that powder collected in bottom 42 can be recycled back to the pumps supplying pressurized powder to the spray guns. Powder not attracted to strip 12 may build up on any surface inside chamber 20, such as endwall ledges, support members, and particularly the spray guns. Periodically, this accumulated powder is sloughed off the surfaces and falls within chamber 20. For those surfaces above strip 12, this sloughed powder can fall onto the upper surface of strip 12 resulting in an area of defective coating. For this reason, the coating system should be designed to exclude any surfaces which can accumulate powder from being within the coating chamber above the passing strip.

Upper spray gun 58 is mounted so that nozzle 68 is positioned within an opening 52 within vestibule 48. Upper spray gun 60 is similarly mounted in an opening 53 of vestibule 50. We have determined the reduced pressure within coating chamber 20 from the vacuum of the gas recirculating system for collecting undeposited powder causes sufficient air draft to prevent any undeposited powder from spray guns 58, 60 from escaping from vestibules 48, 50 to outside chamber 20 into the work area. Of course, positioning spray guns 62,64,66 outside chamber 20 is unnecessary since any build up of powder that sloughs from these lower surfaces would fall into collection bottom 42 rather than onto strip 12.

Figure 3:
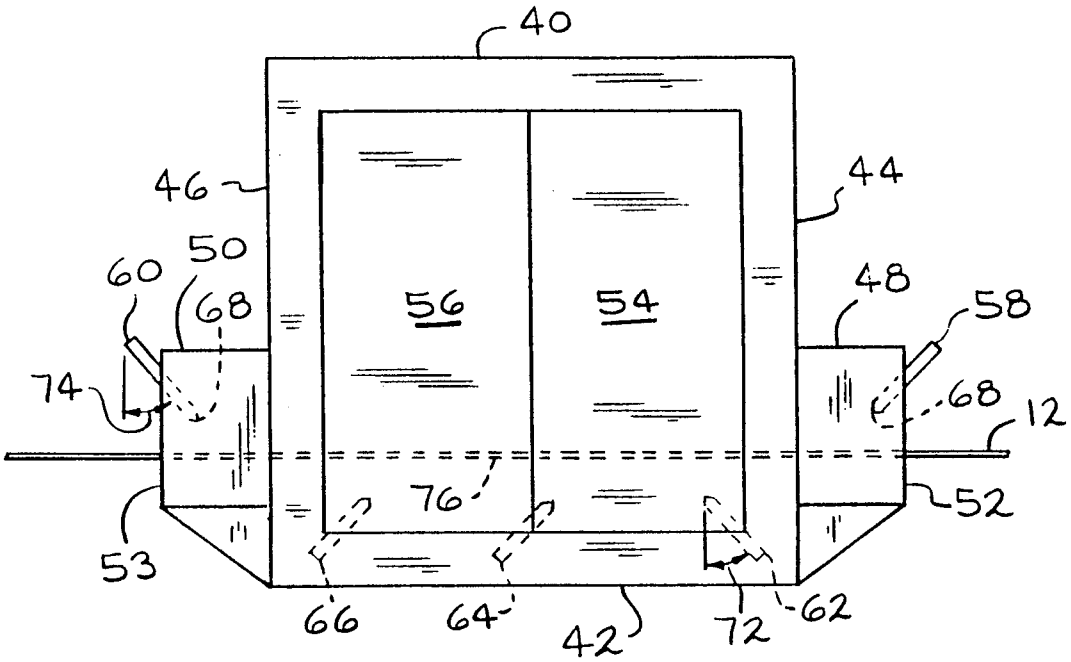
FIG. 3 is a longitudinal elevation view of the coating chamber of FIG. 2.

Several spray guns are transversely positioned and evenly spaced across the width of a wide horizontally moving metal strip, such as illustrated in FIGS. 2 and 3, to insure complete substrate coverage. Because of gravity and the reduced pressure in chamber 20, some of the powder particles blown from lower spray guns 62, 64, 66 may not reach and become attached to bottom surface 76 of strip 12. If so, the thickness of the powder layer deposited by bottom spray guns 62, 64, 66 would be less than the thickness of the powder layer deposited by upper spray guns 58, 60. To insure the bottom powder thickness is about the same as the top powder thickness, additional more closely spaced spray guns may be installed below the strip. Alternatively, the same number of spray guns can be used below the strip as above the strip if the nozzles of the lower spray guns can be adjusted to increase the powder output. In the example of FIGS. 2 and 3, the lower spray guns are more closely spaced than the upper spray guns, i.e., an additional lower spray gun is used. Upper spray guns 58, 60 are spaced so that there is minimal overlap of the powder spray pattern. For bottom spray guns 62, 64, 66 the spray pattern overlap should be somewhat greater than that for upper spray guns 58, 60.

In some applications it is desirable to produce a thinner coating on one side of the strip than that on the other side of the strip. Such a coating is commonly referred to as a differential coating or a differentially coated strip. For differentially coated strip, the thin coated side could be produced as the top side of a horizontally coated strip. The number of spray guns above the strip could be the same as or fewer than the number of spray guns below the strip. The nozzles of the upper spray guns can be adjusted to reduce the powder flow, as necessary, to obtain the desired reduced coating thickness.

FIG. 2 illustrates that the spray guns on each side of the strip are not transversely positioned adjacent to one another. Rather, their positioning is a staggered and opposed relationship. All the spray guns are generally aligned parallel to the strip rolling direction or passline direction 70. Upper spray gun 60 is positioned in exit vestibule 50 of chamber 20 and pointed toward oncoming strip 12 while upper spray gun 58 is positioned in entrance vestibule 48 of chamber 20 and pointed in the opposite direction as that of spray gun 60. In a similar manner, lower spray guns 62, 64, 66 preferably are each longitudinally staggered from one another along direction 70 with lower spray guns 64, 66 being pointed in the opposite direction of that of lower spray gun 62. The reason for this staggered-opposing relationship is to maintain a uniform powder thickness both longitudinally along and transversely across metal strip 12. Charged powder is attracted toward strip 12 by traveling within an electrostatic field established between the spray gun and the metal strip. When the spray guns are near one another, i.e., adjacent to one another, the electrostatic field of one spray gun may intersect that of an adjacent spray gun causing interference in the direction of travel of the charged particles toward strip 12. This interference or repelling of similarly charged particles may cause lines of uneven powder thicknesses along the length of strip 12. We have determined this interference can be eliminated by staggering the positions of the spray guns.

By way of an example, cold reduced annealed steel strip having a thickness of 0.77 mm and a width of 30.5 cm was passed through an alkaline cleaning solution, phosphate surface treated and dried. The treated strip was then passed at a speed of 10 mpm through a coating chamber. A thermosetting polyester powder was pumped at a pressure of about 2.1 kg/cm$^2$ through upper spray guns 58, 60 and lower spray guns 62, 64, 66. The spray guns used were Model NPE-2A from the Nordson Corporation. Nozzle 68 of each spray gun was positioned about 15 cm from the strip surface. We determined the nozzle should be positioned about 10–20 cm from the strip surface. If a nozzle is positioned closer than about 10 cm, arcing may occur between the spray gun electrode and the strip. If a nozzle was positioned more than about 20 cm away from the lower strip surface, poor powder deposition occurred because the amount of powder delivered to surface 76 from bottom spray guns 62, 64, 66 is affected by gravity and the reduced pressure within the coating chamber. The coating chamber was 154 cm long with upper nozzles 58, 60 positioned in opposing end walls 44, 46 respectively. Lower nozzle 64 was longitudinally positioned in the middle of the chamber with nozzles 62, 66 positioned about 50 cm on opposite sides thereof. See FIG. 2. The upper spray guns were inclined at an acute angle 74 relative to the upper surface of strip 12 and the lower spray guns were inclined at an acute angle 72 relative to the lower surface of strip 12 as illustrated in FIG. 3. The nozzles should be inclined at an acute angle of at least 20°, preferably about 40°–50°, more preferably about 45°. If this angle is much greater than about 50°. i.e., about parallel with the plane of the strip, the powder is affected by the draft or air currents within chamber 20. On the other hand, if the nozzles are directed at an angle less than 20°, i.e., substantially perpendicular toward the strip surface, the powder tends to impact with or be carried to the surface of the strip by the pressurized carrier gas of the spray gun. Uniform powder thickness is more likely when the charged powder is attracted to the strip by the electrostatic field force between the powder and the strip rather than being propelled toward the strip by the mechanical force of the pressurized carrier gas. Induction coil 22 was 35.6 cm long, using a Tocco power supply of 200 KW, 480 V.A.C. Infrared heater 24 was a 254 cm long Fostoria unit with an output of 57.6 KW.

The parameters for evaluating different powder coated coils are shown in Table 1.

TABLE 1

| Coil* | Speed - m/m | Melt Time - sec (°C.)** | Cure Time - sec (°C.)*** | Ctg. Thick - μm |
|---|---|---|---|---|
| 1 | 6.4 | 6 (260) | 24 (260) | 40 |
| 2 | 6.7 | 5 (260) | 21 (260) | 45 |
| 3 | 6.4 | 6 (232) | 24 (260) | 63 |
| 4 | 3.7 | 9 (232) | 36 (260) | 63 |

*Coils 1 and 2 were coated with 9W116 thermosetting polyester powder sold by ICI/Glidden. Coils 3 and 4 were coated with UT7020 thermosetting polyester powder sold by International Paint.

**Melt Time is the total time in seconds (first number) that the strip was heated by the induction coil and the temperature reached in °C. (number in parenthesis) of the strip. The temperature was at or above the manufacturer's specified curing temperature.

***Cure Time represents the total time in seconds (first number) that the fused coating was inside the infrared curing oven. The second number (in parenthesis) is the temperature °C. that the strip was cured.

After curing, samples from the thermosetting powder coated coils were observed to have a very smooth surface without any visual defects. To evaluate the amount of cure, corrosion protection, and formability, several samples from each coil were subjected to a variety of tests. These tests included a 1-T Bend test, an MEK Rub test (50 double rubs), a Salt Spray test (240 hours), and a Reverse & Direct Impact test (9 Joules). None of the coatings cracked during the bend or impact tests, none of the coatings were removed following the rub tests, and none of the coatings had any red rust following the salt spray test. These results demonstrate that thermosetting polyester powders can be rapidly melted at or above the curing temperature in less than 10 seconds using an induction coil and subsequently held at the curing temperature for over 20 seconds using an infrared heater to form cured coatings having excellent corrosion and formability properties. The total heating times were 30, 26, 30, and 45 seconds for coils 1, 2, 3, and 4 respectively.

Another experiment similar to that described above was made except coils were coated with thermosetting epoxy powder IP HR031G sold by International Paint. Parameters used for processing these coated coils are shown in Table 2.

TABLE 2

| Coil | Speed - m/m | Melt Time - sec (°C.) | Cure Time - sec (°C.) | Ctg. Thick - μm |
|---|---|---|---|---|
| 5 | 4.6 | 5 (270) | 33 (270) | 75 |
| 6 | 7.6 | 3 (260) | 20 (260) | 80 |
| 7 | 9.1 | 2 (260) | 17 (260) | 82 |
| 8 | 12.2 | 2 (240) | 13 (240) | 78 |

Coils 6 and 7 passed the four tests described above for coils 1–4. However, coils 5 and 8 failed. Coil 5 had a burned surface appearance and failed the bend, impact, and salt spray corrosion tests because the coating cracked. Apparently, the coating became somewhat degraded because of being slightly overheated (temperature too high) by the infrared heater. The coating on coil 8 failed all four tests. A time of 13 seconds was insufficient time for curing the coating as demonstrated by failure of the MEK test.

It was suggested above that a metal strip to be plastic coated advantageously could be prepunched or pierced into a continuous string of blanks ready for forming by the customer with the blanks being cut into lengths by shear 30. Production costs would be reduced because the powder and heating those portions of a blank that otherwise would have been scraped in the customer's forming operation would be saved since the steel that would have been scraped could be removed from strip 12 by presses 34 prior to cleaning, surface treating, and powder coating. By removing scrap on coating line 10 prior to cleaning, chemical treating and powder coating rather than during the customer's forming operation also results in more environmentally acceptable and easily recycled scrap. Prepunching the strip prior to coating eliminates cut edge corrosion. The cut edges of the blanks punched from the strip are readily covered by the charged powder on the coating line and protected from corrosion by the plastic coating. If the blanks were punched after coating, the cut metal edges remain exposed and may corrode. Another important benefit of the present invention is for metals having thick plastic coatings, e.g., 125 microns or more. These coating thicknesses are extremely difficult to fabricate without cracking the coatings. Strip having a thick plastic coating can be heated to above the glass transition temperature immediately prior to forming to prevent fracturing the coating. The glass transition temperature is the temperature at which a reversible change in an amorphous polymer or in amorphous regions of a partially crystalline polymer changes from a hard and relatively brittle one to a viscous or rubbery condition.

For a commercial size coating line, a number of factors need be taken into consideration including line speed, coating thickness, spray gun design, and coating appearance. Table 3 can be used as a general guide to determine the total number of spray guns required in the coating chamber.

TABLE 3

| Line Speed - m/m | Strip Width - cm | Ctg. Thick - μm | # Spray Guns |
|---|---|---|---|
| 18.3 | 71 | 150 | 48 |
| 18.3 | 71 | 75 | 24 |
| 18.3 | 71 | 50 | 16 |
| 18.3 | 71 | 25 | 8 |
| 36.6 | 71 | 75 | 48 |

TABLE 3-continued

| Line Speed - m/m | Strip Width - cm | Ctg. Thick - μm | # Spray Guns |
|---|---|---|---|
| 36.6 | 71 | 50 | 32 |
| 36.6 | 71 | 25 | 16 |
| 18.3 | 152 | 75 | 52 |
| 18.3 | 152 | 50 | 35 |
| 18.3 | 152 | 25 | 18 |
| 36.6 | 152 | 75 | 104 |
| 36.6 | 152 | 50 | 70 |
| 36.6 | 152 | 25 | 36 |
| 54.9 | 152 | 75 | 156 |
| 54.9 | 152 | 50 | 70 |
| 54.9 | 152 | 25 | 54 |

For a 71 cm wide strip to be coated with a coating thickness of about 150 microns on each side of the strip, it can be coated at a speed of about 18.3 meters per minute using a total of about 48 spray guns. Half of the spray guns could be positioned on either side of the strip with the nozzles of the lower spray guns adjusted to increase the powder flow rate until the necessary powder thickness is obtained on the bottom surface of the strip. Decreasing the coating thickness in half to 75 microns using the same line speed and width strip would also decrease the number of spray guns in half to 24. Having determined the number of spray guns required, the remaining consideration is to align the spray guns in a direction generally parallel to the rolling direction of the strip and incline the spray guns at the necessary acute angle to the plane of the strip. The spray guns preferably are mounted in a staggered and opposed relationship.

It was indicated in reference to FIGS. 2 and 3 the upper spray guns preferably are positioned outside the coating chamber. This is to prevent powder from sloughing from the upper surfaces of the spray guns onto the upper surface of the strip causing coating defects. For some applications requiring thick coatings, i.e., ≧125 microns for corrugated pipe, the cosmetic appearance of the coating is not important so long as the coating can be fabricated without cracking and has good corrosion resistance. If cosmetic appearance is important when a thick coating is required, it may not be possible to position all the upper guns outside the coating chamber within the entrance and exit vestibules because the large number of spray guns required would cause the spray guns to be positioned too close to one another. In this situation, at least some of the spray guns would be positioned on the roof of the coating chamber. The spray guns would be generally aligned parallel to and inclined with the rolling direction of the strip preferably in a staggered and opposed relationship similar to that for the lower spray guns illustrated in FIGS. 2 and 3. Openings in the roof of the coating chamber would receive the nozzles of the spray guns with the body portions of the spray guns remaining outside the coating chamber.

It will be understood various modifications can be made to the invention without departing from the scope and spirit of it. Therefore, the limits of the invention should be determined from the appended claims.

We claim:

1. A method of producing plastic coated strip, comprising:

surface treating a metal strip, passing said treated strip through an enclosed coating chamber, coating both sides of said treated strip with a charged powder in said chamber, said powder being carried by a gas and blown from an electrostatic spray gun, inductively heating said powder coated strip to a temperature above the melting point of said powder, maintaining said coated strip above said melting point so that the fused coating has sufficient time to form an adherent coating having a smooth surface and a uniform thickness.

2. The coating method of claim 1 including the additional steps of prepunching said strip into a string of continuous blanks having said fused coating and shearing said coated string of blanks into cut lengths.

3. The coating method of claim 1 wherein said strip is inductively heated for no greater than 10 seconds.

4. The coating method of claim 1 wherein said powder is thermosetting and selected from the group consisting of polyester, epoxy, polyester-epoxy hybrid, acrylic and urethane.

5. The coating method of claim 4 wherein said time is at least 15 seconds.

6. The coating method of claim 5 wherein the total heating time is less than 60 seconds.

7. The coating method of claim 1 wherein said coating has a thickness of at least 10 microns.

8. The coating method of claim 1 wherein said fused coating is maintained in an infrared heater having a wave length of 0.8–3.3 microns.

9. The coating method of claim 1 including the additional step of rapidly cooling said strip to immediately solidify said adherent coating.

10. The coating method of claim 1 including the additional step of preheating said treated strip.

11. The coating method of claim 1 including the additional step of cleaning said strip of dirt, oil, oxides, and the like prior to said surface treatment.

12. The coating method of claim 1 wherein said adherent coating has a thickness of at least 125 microns and including the additional steps of:

rapidly cooling said strip to immediately solidify said coating, reheating said cooled strip to a temperature of at least the glass transition temperature of said coating, forming said reheated strip into an article while above said glass transition temperature, whereby said coating on said formed article is free of cracks.

13. The coating method of claim 1 wherein said chamber includes a plurality of said spray guns on each side of said strip, said spray guns generally aligned parallel to the rolling direction of said strip, one of said spray guns on one side of said strip blowing said powder in the same direction as the movement of said strip, another of said spray guns on said one side of said strip blowing said powder in the opposite direction.

14. The coating method of claim 13 wherein said strip is passed horizontally through said chamber and said spray guns being positioned above and below said strip.

15. The coating method of claim 14 producing a differentially coated strip wherein said spray guns deposit a powder thickness on the upper surface of said strip thinner than that on the lower surface of said strip.

16. A method of fabricating plastic coated strip, comprising:

cleaning a metal strip of dirt, oil, oxides, and the like, surface treating said cleaned strip, passing said treated strip through an enclosed coating chamber, coating both sides of said treated strip with electrostatically charged thermosetting powder, inductively heating said powder coated strip to a temperature above the melting point of said powder using a frequency of no greater than 10 kHz to melt said powder, maintaining the fused coating above said melting point for sufficient time to form a cured coating having a smooth surface and a uniform thickness of at least 10 microns on each surface of said strip, fabricating said strip into an article without cracking said cured coating.

17. A method of plastic coating strip, comprising:

cleaning a metal strip of dirt, oil, oxides, and the like, surface treating said cleaned strip, horizontally passing said treated strip through an enclosed coating chamber, coating both sides of said treated strip in said chamber with a charged thermosetting powder, said powder being carried by a gas and blown from electrostatic spray guns, positioning a plurality of said guns above and below said strip, aligning said spray guns generally parallel to the rolling direction of said strip, inductively heating said powder coated strip for no greater than 10 seconds to a temperature above the melting point of said powder, maintaining said coated strip in an infrared heater for at least 15 seconds above said melting point so that the fused coating has sufficient time to form a cured coating having a smooth surface and a uniform thickness of at least 10 microns on each surface of said strip, whereby the total heating time is less than 60 seconds.

18. A method of plastic coating strip, comprising:

prepunching a metal strip into a string of continuous blanks, cleaning said string of blanks of dirt, oil, oxides, and the like, surface treating said string of blanks, horizontally passing said treated string of blanks through an enclosed coating chamber, coating both sides of said treated string of blanks in said chamber with a charged plastic powder, said powder being carried by a gas and blown from electrostatic spray guns, positioning a plurality of said guns above and below said string of blanks, aligning said spray guns generally parallel to the rolling direction of said string of blanks, inductively heating said powder coated string of blanks for no greater than 10 seconds to a temperature above the melting point of said powder, maintaining said coated string of blanks in an infrared heater for sufficient time to form a coating having a smooth surface and a uniform thickness of at least 10 microns on each surface of said string of blanks, shearing said string of blanks into cut lengths.

* * * * *